US006244328B1

(12) United States Patent
Grolla

(10) Patent No.: US 6,244,328 B1
(45) Date of Patent: Jun. 12, 2001

(54) MOLD FOR AUTOMATICALLY WORKING MOLD SYSTEMS AND A PROCESS FOR THE MANUFACTURE OF THE MOLDS

(75) Inventor: Herbert Grolla, Bad Laasphe (DE)

(73) Assignee: Heinrich Wagner Sinto Maschinenfabrik GmbH, Bad Laasphe (DE)

( * ) Notice: Subject to any disclaimer, the term of this patent is extended or adjusted under 35 U.S.C. 154(b) by 0 days.

(21) Appl. No.: 09/256,169

(22) Filed: Feb. 23, 1999

(51) Int. Cl.[7] ..... B22C 21/02; B22C 9/08; B22C 9/10

(52) U.S. Cl. ..... 164/359; 164/360; 164/365; 164/384; 164/392

(58) Field of Search ..... 164/15, 27, 384, 164/392, 393, 359, 360, 363, 365

(56) References Cited

U.S. PATENT DOCUMENTS 4,113,001 9/1978 Workman .

FOREIGN PATENT DOCUMENTS 26 52 657 6/1977 (DE) .
2579494 * 10/1986 (FR) ..... 164/363
55-106656 8/1980 (JP) .
55-106658 8/1980 (JP) .
846061 * 10/1986 (RU) ..... 164/363
WO91/12104 8/1991 (WO) .

* cited by examiner

*Primary Examiner*—Kuang Y. Lin
(74) *Attorney, Agent, or Firm*—Flynn, Thiel, Boutell & Tanis, P.C.

(57) ABSTRACT

Flask-bound molds include two molding-flask halves, which have means (15) for the transport thereof on automatic mold systems. The molding flask receives a bound sand mold (8), which has cores (13), a pouring funnel (6) and a feeder passage (9). In order to be able to cast complicated castings also out of aluminum in such molds and to avoid the expensive finish work for the feeder and pouring funnel and in order to guarantee at the same time good core ventilation, the molding flask (4) has in the area of its parting plane a recess extending over at least a portion of the length and width of one side of the molding flask, whereby the pouring funnel (6) and the feeder (9) end in the area of the recess and the feeder is constructed within the sand mold (8) of the mold (1).

6 Claims, 2 Drawing Sheets

1
2
3
4
5
6
7
8
9
10
11
12
13
14
15

14
13
13
8

14

9

9

MOLD FOR AUTOMATICALLY WORKING MOLD SYSTEMS AND A PROCESS FOR THE MANUFACTURE OF THE MOLDS

FIELD OF THE INVENTION

The invention relates to a mold and a process for the manufacture of a mold comprising a molding flask formed of two molding-flask halves, which molding flask has means for the transport on automatic mold systems and receives a bound sand mold, which sand mold, if necessary, is provided with cores and with a pouring funnel and a feeder.

BACKGROUND OF THE INVENTION

Molds with bound molding sand are either manufactured with molding flasks, which consist of two molding-flask halves, whereby this molding flask is as a rule constructed frame-shaped and has running boards on its front and rear sides, with which the molding flask can be transported on a roller train of an automatic mold system. This molding flask provides the sand mold bound therein the necessary strength so that same can be easily transported. The sand for the mold can be clay-bound, which guarantees an inexpensive reprocessing of the molding sand.

Molds without flasks are also known and are assembled dependent on the casting out of a plurality of individual parts, whereby these molds are no longer clay-bound but are chemically bound in order to obtain a sufficient strength for their handling and casting ability. These chemically bound sand molds require expensive machines for the manufacture of the partial molds and cores and machines for, in turn, assembling these parts to form a mold. Aside of the high input of machines, which must here take place, a further disadvantage is that the reprocessing of the sand is difficult. This represents a high expense factor in addition to the expensive molding and mounting machines.

Green-sand molds without a flask are also known and are built of individual identical square-shaped blocks, which have on two oppositely lying sides each defining a portion of the mold cavity. The casting inlet and also the feeder is hereby formed in the blocks. These blocks are then moved towards one another so that their mold cavity portions supplement and support one another. The molding sand is thereby shot in from above, which means that the mold areas, which lie in the shape of the model, do not solidify like the remaining areas. Furthermore the feeder can only exist to a limited degree in the mold and also essentially only laterally of the actual mold cavity, which strongly limits the quality of the feeder. By shooting in the molding sand moreover also a large wear on molds occurs, which makes the process expensive. A further disadvantage is that the cores must be inserted into a laterally directed mold and this must be done in the available cycle time, which on the one hand demands expensive automatic machines and on the other hand is dangerous manual work. An important disadvantage is furthermore that such green-sand molds without a flask are not suited for the manufacture of complicated castings, as for example engine blocks or cylinder heads, in particular when these consist of aluminum.

Moreover, molding sand in molding flasks can not only be clay-bound but is also significantly less expensive to manufacture. In order to manufacture such a molding flask one must merely place each one half of the molding flask separately onto a model plate, whereby the molding flask is then filled with sand. After mechanically compressing the molding sand, the mold half is finished. The horizontally lying mold half is then turned upwardly with the mold cavity therein so that cores can be inserted. The molding flasks are placed one on top of the other for casting, whereby earlier the mold opening and the feeder must be worked into the molding sand in the then upper molding-flask half. This is done prior to the turning of the upper molding flask by using rotating tools. These molding flasks are then cast in a lying position, whereby it is here disadvantageous that only a relatively small volume remains for the feeder in the mold and in addition the feeding of the mold parts lying at the mold bottom is not always optimally achieved.

Whereas it is no problem in the chemically bound molds without a flask to form the feeder and also the pouring funnel right away in the mold, whereby the feeder and pouring funnel are arranged on the side of the mold, which is the most advantageous position for casting of the casted part. The feeding of the solidifying casting is thus significantly more advantageous in chemically bound molds without a flask compared with molds with molding flasks. In particular, it is not necessary to additionally mount yet another feeder onto the molding flask in order to produce the hydrostatic pressure required for the feeding. Of course, these molds are not only expensive with respect to material and manufacture but also demand extremely high installation capital.

It is indeed possible in the case of manufacturing the green-sand molds without a molding flask to at the same time manufacture the pouring funnel without any relieve problems, however, the construction of the feeder creates problems especially since the feeder reduces the cross section available for shooting in the sand. Such molds are less suited for the pouring in of aluminum especially since here large effective feeders are needed.

The core ventilation represents a significant problem both in the case of molds without flasks and in the case of molds with molding flasks, which problem has up to now not been satisfactorily solved.

SUMMARY OF THE INVENTION

The basic purpose of the invention is to construct a mold with a molding flask, which has a mold of a bound molding sand, in such a manner that same can be utilized in automatically working mold systems and can be manufactured horizontally in the usual manner, in which additional finishing steps on the pouring funnel and the feeder and also additional feeders to be placed onto the mold are not needed, and moreover an effective ventilation of the cores if guaranteed in the mold. A further purpose of the invention is to provide a process for the manufacture of such a mold.

This purpose is attained for a mold of the above-identified type in accordance with the invention in such a manner that the molding flask has in the area of its parting plane a recess extending over at least one portion of the length and width of one side of the molding flask, that the pouring funnel and the feeder end in the area of the recess, and that the feeder is constructed within the bound molding sand in the mold.

Thus the molding flasks for molds with bound molding sands can be manufactured in the usual manner, namely the frame of the molding flask is placed onto a model plate, is filled with sand and is compressed. The two molding-flask halves are manufactured in the same way. The difference of the present molding flasks with respect to the conventional molding flasks is that the feeder and pouring funnel are no longer constructed on the open side of the mold frame, namely on the upper open molding-flask half, but that the opening before the pouring funnel and also the feeder is placed along the parting plane of the molding-flask. This means that the casting operation involving the mold occurs no longer with the mold lying horizontally, as is the case in conventional molds with molding flasks, but instead occurs in a standing (vertical) position. By shifting the pouring opening and also the feeder into the mold parting plane and through the so caused standing casting operation of the molding flask, it is possible to form the feeder and the pouring funnel without any additional input (steps) at the same time as the mold is manufactured so that any additional finishing is not required. Moreover, since the casting operation involving the mold occurs in a standing position, there remains as a rule sufficient space above the casting in the mold to house the needed volume for the feeder. Also this relatively large space makes it possible to construct the feeder in such a manner that the necessary hydrostatic pressure for feeding is obtained.

According to an advantageous embodiment of the invention, the cores are arranged with one end extending upwardly through the opening in the mold frame above the mold sand and, if necessary, through the feeder to above the level of the pouring opening of the feeder so that the core ventilation can occur directly above the one end of the core. This significantly reduces the danger of casting errors. The molding flask has a recess in the parting plane, in which the feeder and pouring funnel are arranged, which recess can be V or U-shaped in cross section. The pouring in of the casting material occurs advantageously via a bottom casting, whereby the pouring channel ends below the casting piece and is connected to same through a passage.

The molding flask is manufactured in a lying position, namely the two halves of the molding flask are manufactured in the usual manner, whereby in contrast to the prior state of the art the pouring funnel and the feeder are right from the start coformed laterally into the open sides of the molding flask halves. Through this lateral arrangement it is possible to manufacture the feeder and also the pouring funnel in such a manner that additional finishing is no longer necessary. The molding flasks are then arranged on a roller train in such a manner that the mold cavity open side is upwardly oriented. The cores are then inserted in this position, whereby the one mold half is then placed in a conventional manner above the other one. The finished mold is then turned 90° so that same is now further transported with the pouring opening in upward direction on a further roller train, which is now as a rule narrower than the first mentioned roller train. The mold is cast in this position. After the mold has solidified, the molding sand including the casting is advantageously in the upright positioned mold pressed through a stamp out of the mold frame, whereby the molding flask can remain on the roller train. The two halves of the molding flask are in a conventional manner again separated, then turned, and the mold forming process starts again.

BRIEF DESCRIPTION OF THE DRAWINGS

One exemplary embodiment of the invention will be described in greater detail hereinafter in connection with the drawings, in which.

DETAILED DESCRIPTION

Figures 1, 2, 3, 4:
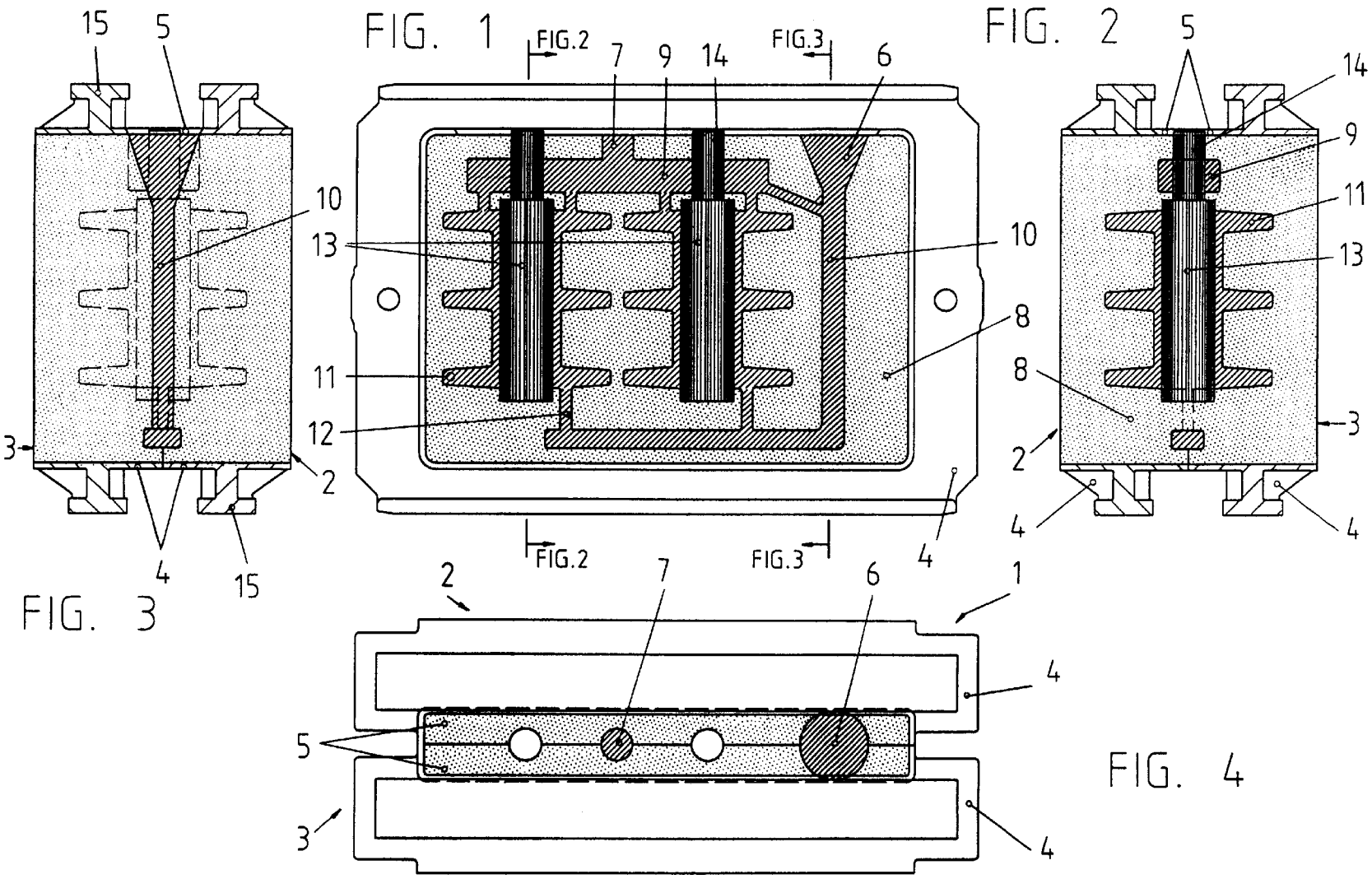
FIG. 1 shows a cross section along a parting plane of a molding flask.
FIG. 2 illustrates two molding-flask halves joined together to form a mold corresponding to the cross section along the line 2—2 of FIG. 1.
FIG. 3 shows a cross section along the line 3—3 of FIG. 1.
FIG. 4 shows a top view of a molding flask corresponding to FIG. 1.

FIGS. 1 to 4 illustrate an embodiment of a mold flask 1 of the invention. The mold 1 consists of two mold halves, whereby each mold flask half has a mold frame 4, which has one half of a V-shaped recess 5 at its respective side or top end portion at the mold parting plane. This V-shaped recess 5 extends, as can particularly be seen in FIG. 4, over a portion of the width and length of each molding flask half 4. Thus an opening is provided to the molding sand 8 in the molding flask, whereat the pouring funnel 6 and the opening 7 for the feeder passage (hereafter feeder) 9 arranged inside of the bound sand 8 extend into the area of the recess 5. The pouring funnel 6 is connected to a pouring inlet 10, which extends below the casting mold cavity 11 and is connected through connecting passages 12 to said casting mold cavity 11.

Two cores 13 are placed into the casting cavity 11 in the exemplary embodiment, which cores 13 have an extended end section 14, which section extends through the feeder 9 and ends above the feeder and the sand mold 8. This end 14, which ends above the level of the feeder and the sand mold, guarantees an effective core ventilation and also a ventilation of the mold.

The recess 5 in the two mold halves 2 and 3 is, when the halves are assembled, designed V-shaped in cross section. It is also conceivable to provide here a U-shaped cutout.

Figures 5, 6, 7, 8:
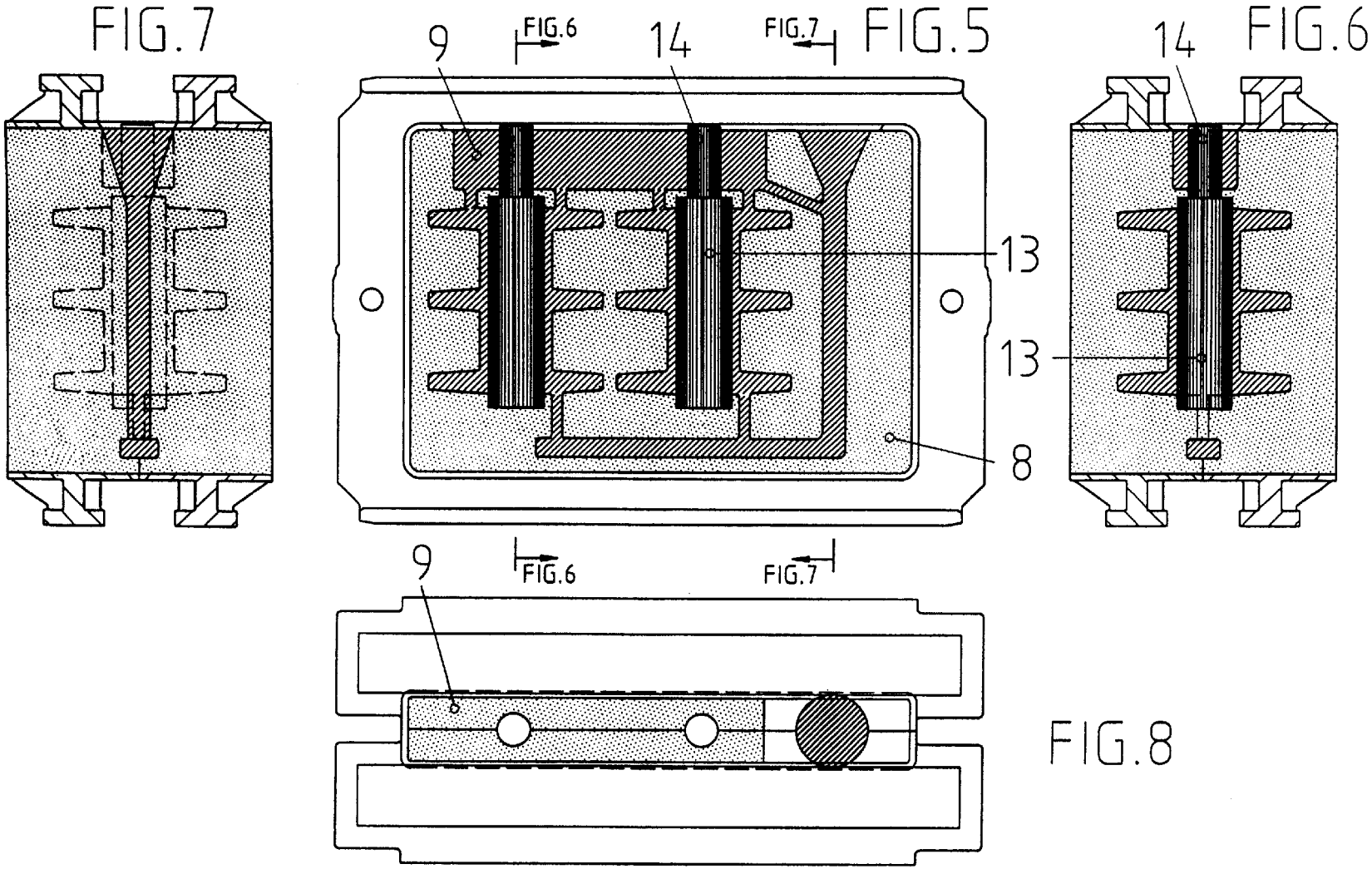
FIG. 5 shows a cross section corresponding to FIG. 1, however, with a feeder, which reaches to the surface of the mold.
FIG. 6 shows a cross section along the line 6—6 of FIG. 5.
FIG. 7 shows a cross section along the line 7—7 of FIG. 5.
FIG. 8 shows a top view of FIG. 5.

Each molding-flask half 4 has running boards 15, with which the molding flask can be transported lying horizontally on, for example, roller trains, and also standing on other roller trains arranged correspondingly more narrowly than when on the first mentioned roller trains, i.e. the molding flask has a height and width (FIGS. 2 and 7) less than its length (FIG. 1). Each molding-flask half 4 is for the purpose of inserting the core transported horizontally lying on the roller train, namely with the open side of the mold cavity 11 in each molding-flask half facing upwardly (FIG. 1). Thus, the cores 13 can be easily inserted into the mold cavity 11 without being held with special means as is the case with the molds without a molding flask. These cores 13 are inserted into the bottom molding-flask half and the other molding-flask half is placed onto the horizontally positioned bottom one. The assembled molding flask 1 is subsequently turned at 90° about its longitudinal axis so that the pouring funnel and the feeder open upwardly instead of sidewardly (FIGS. 2 and 3). The casting operation can then take place.

The removal of the molding sand and cast part from the molding flask 1 can also be done in a standing orientation, whereby the molding flask does not need to be removed from the roller train. It is here merely necessary to press the molding sand including the created cast part laterally out of the mold frame 4.

The exemplary embodiment according to FIGS. 5 to 8 corresponds with the exemplary embodiment according to FIGS. 1 to 4 with the difference that the feeder 9 is not, as this is the case in the exemplary embodiment according to FIGS. 1 to 4, arranged within the sand mold 8 and is, accessible only through one opening 7 but that instead here the opening corresponds with the cross section of the feeder, i.e., is recessed in the top of the molding sand at recess 5. Otherwise the arrangement of the cores 13 is identical, whereby here also the ends 14 of the cores 13 end above the level of the maximum fill-level height of the feeder 9.

Although a particular preferred embodiment of the invention has been disclosed in detail for illustrative purposes, it will be recognized that variations or modifications of the disclosed apparatus, including the rearrangement of parts, lie within the scope of the present invention.

I claim:

1. A casting mold, comprising a molding box which is formed by two molding-box halves and which is provided with means for conveying to automatic casting plants and receives a bound sand mold which is provided with cores, a pouring funnel and a feeding means, wherein the molding box is provided in the region of its separation plane with a recess extending over at least part of the length as well as the width of one side of the molding box, wherein the pouring funnel and the feeding means open in the region of the recess, the feeding means is formed inside the sand mold in the casting mold, and the cores are designed and arranged so that the cores pass through the feeding means and open above the sand mold.

2. A casting mold according to claim 1, wherein a pouring channel extends at the side of and below the casting cavities in the sand mold.

3. A casting mold according to claim 1, wherein the cross section of the recess in the molding box is V-shaped or U-shaped.

4. A method of producing a casting utilizing the casting mold according to claim 1, comprising the steps of: filling each molding box half with sand such that the sand is shaped in a horizontal state, jointly forming the feeding means, the pouring funnel and apertures for the cores in the sand mold in one operation; turning the molding box halves with the plane of the feeding means and pouring funnel and thus with the molding cavity upwards in order to insert the cores; arranging the cores in the sand mold so that an extended end of the cores emerge from the sand mold, wherein one or more of the cores pass through the feeding means; and joining the molding box halves and turning the molding box halves through 90° so that the casting takes place into the vertical casting mold.

5. A method according to claim 4, including filling the casting mold in a rising casting procedure.

6. A method according to claim 5, including pouring fresh metal into the feeding means or into the opening of the feeding means approximately at the moment at which the molding cavity of the casting mold is filled with liquid metal.

* * * * *